US007525503B2

(12) United States Patent
Wong et al.

(10) Patent No.: US 7,525,503 B2
(45) Date of Patent: Apr. 28, 2009

(54) DIGITAL TELEVISION RECEIVING ANTENNA FOR PLUG-AND-PLAY DEVICE

(75) Inventors: Kin-Lu Wong, Kao-Hsiung (TW); Wei-Yu Li, I-Lan (TW); Saou-Wen Su, Taipei (TW)

(73) Assignees: Lite-On Technology Corp., Neihu, Taipei (TW); National Sun Yat-Sen University, Gushan District, Kao-Hsiung (TW)

( * ) Notice: Subject to any disclaimer, the term of this patent is extended or adjusted under 35 U.S.C. 154(b) by 0 days.

(21) Appl. No.: 11/688,241

(22) Filed: Mar. 19, 2007

(65) Prior Publication Data

US 2008/0136739 A1 Jun. 12, 2008

(30) Foreign Application Priority Data

Dec. 6, 2006 (TW) ..... 95145467 A

(51) Int. Cl.
*H01Q 1/38* (2006.01)

(52) U.S. Cl. ..... 343/846; 343/702; 343/805; 343/881

(58) Field of Classification Search ..... 343/702, 343/795, 805, 806, 846, 880–882, 895
See application file for complete search history.

(56) References Cited

U.S. PATENT DOCUMENTS 4,313,119 A * 1/1982 Garay et al. ..... 343/702

* cited by examiner

*Primary Examiner*—Michael C Wimer
(74) *Attorney, Agent, or Firm*—Winston Hsu

(57) ABSTRACT

The present invention provides a digital television receiving antenna for a plug-and-play device. The digital television receiving antenna includes a first conducting portion; and a second conducting portion, coupled to the first conducting portion and having a resonance path, wherein the second conducting portion is position-adjustable relatively to the first conducting portion, and an effective length of the resonance path is greater than a straight-line distance between two end points of the resonance path.

13 Claims, 9 Drawing Sheets

DIGITAL TELEVISION RECEIVING ANTENNA FOR PLUG-AND-PLAY DEVICE

BACKGROUND OF THE INVENTION

1. Field of the Invention

The present invention relates to an antenna, and more particularly, to a digital television receiving antenna for a plug-and-play device.

2. Description of the Prior Art

There are three main technical standards in ground digital television broadcasting technology globally: ATSC (Advanced Television Systems Committee) in America, DVB-T (Digital Video Broadcasting-Terrestrial) in Europe, and ISDB-T (Terrestrial Integrated Services Digital Broadcasting) in Japan. Distinct from the traditional analog television broadcasting system utilizing NTSC (National Television Standard Committee) standard, the digital television broadcasting system transfers television signals from an analog format to a digital format. After digitized, the television signals can be further compressed using an appropriate signal processing algorithm before transmission, and thus the transmission efficiency of the operating bandwidth can be enhanced. Moreover, noises in the digitized television signals generated during the transmission can be easily removed using an appropriate signal processing algorithm, thereby greatly improving signal quality at the user end. Compared with other systems, the DVB-T system not only has the advantage of mobile reception capability, but also effectively solves the multi-path interference problems utilizing the coded orthogonal frequency division multiplexing (COFDM) standard. Accordingly, the DVB-T system is utilized in Taiwan currently.

Presently, it is common to design a digital television signal receiving or demodulating module on a small-sized system ground component in a digital television receiving device. It is also common to utilize a universal serial bus (USB) interface in a desktop or notebook computer to connect with a plug-and-play digital television receiving device. Typically, the plug-and-play digital television receiving device utilizes an external antenna, and thus an additional transmission cord for connecting the antenna to the device is necessary. The additional transmission cord not only consumes excessive space, but also degrades the portability and the appearance of the whole device. Further, frequent attachment/detachment of the transmission cord to/from the device may cause the problem of contact failure between components of the device. For example, a telescopic monopole antenna is conventionally used as the external antenna. In such a case, the whole dimension of the conventional telescopic monopole antenna in use is comparatively large, and that is an obvious drawback in practical application.

SUMMARY OF THE INVENTION

To solve the problems, the present invention provides a creative minimized planar digital television receiving antenna capable of operating in Taiwan digital television channels (i.e. 530-602 MHz). The antenna of the present invention has advantages of simple structure, easy manufacture, and light and thin body. By properly minimizing the antenna, the total height of the antenna in use can be greatly decreased. Moreover, when the antenna is not in use, the antenna can be folded directly, thereby minimizing necessary storage space. Accordingly, the antenna of the present invention is appropriate for a plug-and-play device as a digital television receiving antenna.

One of the objectives of the present invention is to provide a creative minimized digital television receiving antenna appropriate for a plug-and-play device. The operating bandwidth of the antenna of the present invention covers the Taiwan digital television channels (i.e. 530-602 MHz). Additionally, the antenna of the present invention has advantages of simple structure, easy manufacture, and light and thin body. Moreover, when the antenna is not in use, the antenna can be folded directly, thereby minimizing necessary storage space.

According to an embodiment of the present invention, the present invention discloses a digital television receiving antenna for a plug-and-play device, comprising: a first conducting portion; and a second conducting portion, coupled to the first conducting portion and having a resonance path, wherein the second conducting portion is position-adjustable relatively to the first conducting portion, and an effective length of the resonance path is greater than a straight-line distance between two end points of the resonance path.

Experimental results show that the antenna of the present invention can operate in the Taiwan digital television channels (i.e. 530-602 MHz). Moreover, the radiation pattern and the radiation efficiency of the antenna are suitable when the antenna is used as a digital television receiving antenna.

In the present invention, by properly designing the shape of a meandering radiating metal arm (i.e. second conducting portion) of the antenna, the resonance path of the meandering radiating metal arm can be effectively lengthened. Thus, the whole dimension of the antenna can be minimized, and the total height of the antenna in use can be greatly decreased. Moreover, the antenna of the present invention can satisfy the requirement of impedance bandwidth and radiation efficiency for the Taiwan digital television channels (i.e. 530-602 MHz). Additionally, the antenna of the present invention has advantages of simple structure, easy manufacture, and light and thin body. A radiating metal sheet (i.e. first conducting portion) of the antenna of the present invention is a complete rectangle and thus can be used as a system ground plane of the plug-and-play device. Accordingly, the antenna of the present invention is appropriate for the plug-and-play device as a digital television receiving antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
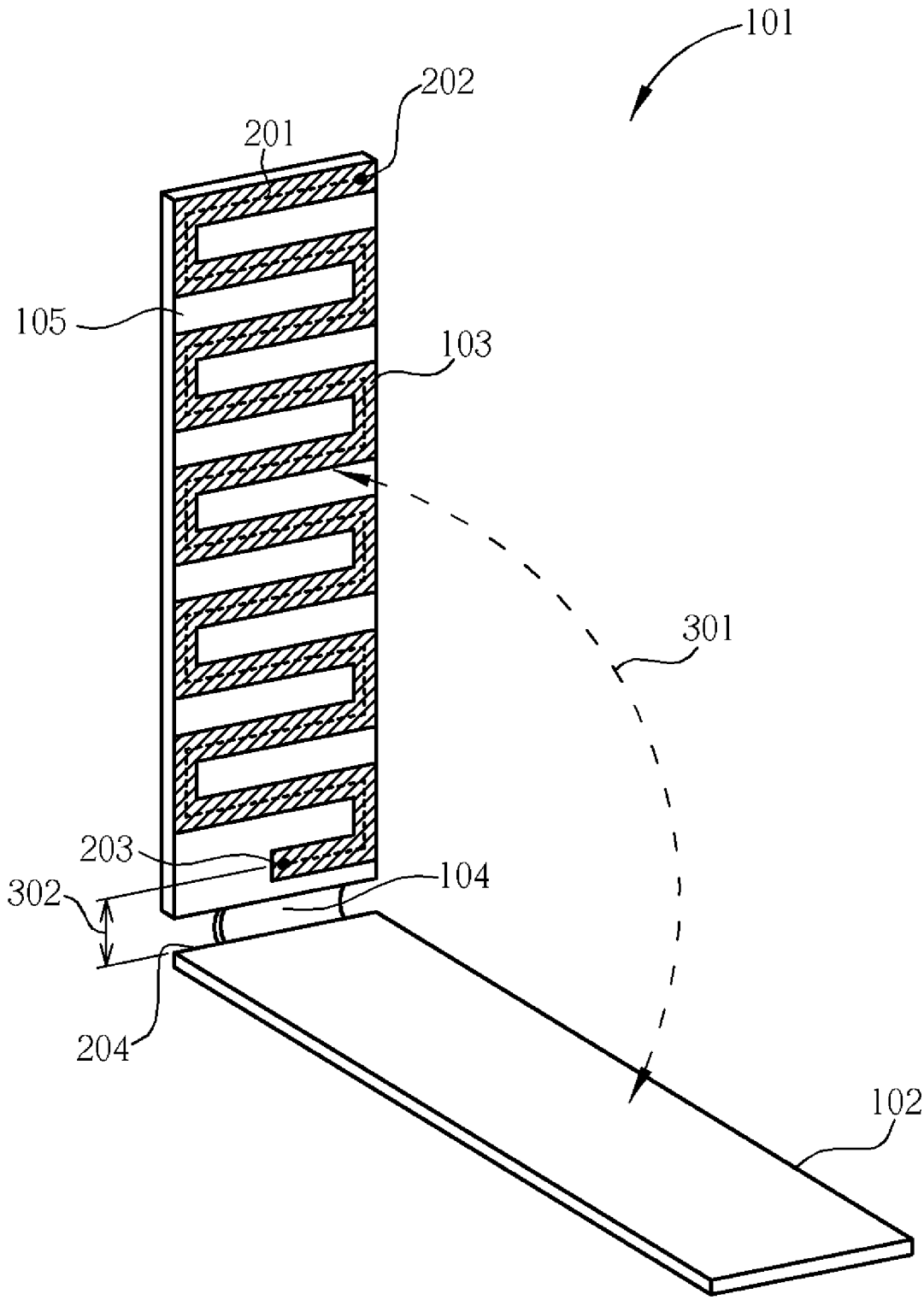
FIG. 1 is a structural diagram illustrating an antenna according to an embodiment of the present invention.

FIG. 1 is a structural diagram illustrating an antenna 101 according to an embodiment of the present invention. The antenna 101 is a digital television receiving antenna and can be configured in a plug-and-play device. As shown in FIG. 1, the antenna 101 comprises a radiating metal sheet (i.e. first conducting portion) 102, a meandering radiating metal arm (i.e. second conducting portion) 103, a flexible insulating portion 104, and a substrate plate 105. The radiating metal sheet 102 and the meandering radiating metal arm 103 are a pair of resonating radiators. The radiating metal sheet 102 is substantially a rectangular radiating metal plate and can be used as the system ground plane of the plug-and-play device. The meandering radiating metal arm 103 is electrically coupled to the radiating metal sheet 102. There exists a flare angle (or an included angle) 301 between the radiating metal sheet 102 and the meandering radiating metal arm 103. The meandering radiating metal arm 103 has a resonance path 201 thereon, and one of two end points of the resonance path 201 is the feeding point 203 of the antenna 101. The feeding point 203 is apart from a short side 204 of the radiating metal sheet 102 at a preset distance 302. The antenna 101 operates preferably when the flare angle 301 is between 45 and 180 degrees, and the preset distance 302 is less than 5 mm. As shown in FIG. 1, because the meandering radiating metal arm 103 is meandering, an effective length (as indicated by a dotted line) of the resonance path 201 of the meandering radiating metal arm 103 is greater than a straight-line distance between the two end points 202, 203 of the resonance path 201. In the present invention, the shape of the meandering radiating metal arm 103 is properly designed, so the resonance path 201 of the meandering radiating metal arm 103 is effectively lengthened. The whole dimension of the antenna 101 is thus minimized, and the total height of the antenna 101 in use is greatly decreased.

Figure 2:
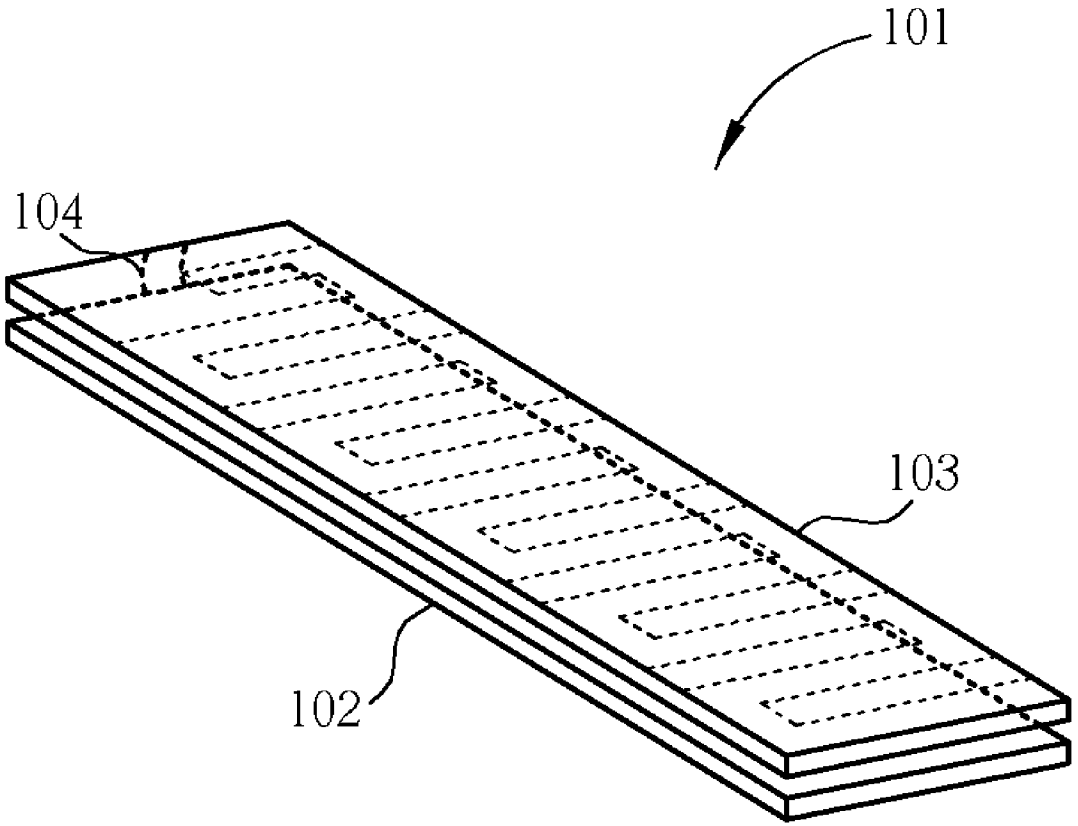
FIG. 2 is another structural diagram illustrating the antenna in FIG. 1, wherein a meandering radiating metal arm of the antenna is adjusted to a closed position.

FIG. 2 is another structural diagram illustrating the antenna 101, wherein the meandering radiating metal arm 103 of the antenna 101 is adjusted to a closed position (i.e. when the flare angle 301 is 0 degree). As shown in FIG. 2, the radiating metal sheet 102 and the meandering radiating metal arm 103 are both thin and light plates. Moreover, the shape of the antenna 101 can be modified to fit the appearance of the plug-and-play device. Hence, the overall appearance of the device can be more artistic when the antenna 101 operates as a digital television receiving antenna (i.e. when the flare angle 301 is between 45 and 180 degrees). On the other hand, when the antenna 101 is not in use, the meandering radiating metal arm 103 can be adjusted to the closed position as shown in FIG. 2. In other words, the antenna 101 can be folded directly, thereby minimizing necessary storage space.

Furthermore, as shown in FIG. 1, the substrate plate 105 is coupled to the radiating metal sheet 102 via the flexible insulating portion 104. By bending the flexible insulating portion 104, the position of the substrate plate 105 (and the meandering radiating metal arm 103 on the substrate plate 105) can be adjusted relatively to the radiating metal sheet 102. Moreover, as shown in FIG. 2, when the meandering radiating metal arm 103 is adjusted to the closed position (i.e. the position of the meandering radiating metal arm 103 in FIG. 2), the radiating metal sheet 102 and the meandering radiating metal arm 103 are substantially parallel.

Figure 3:
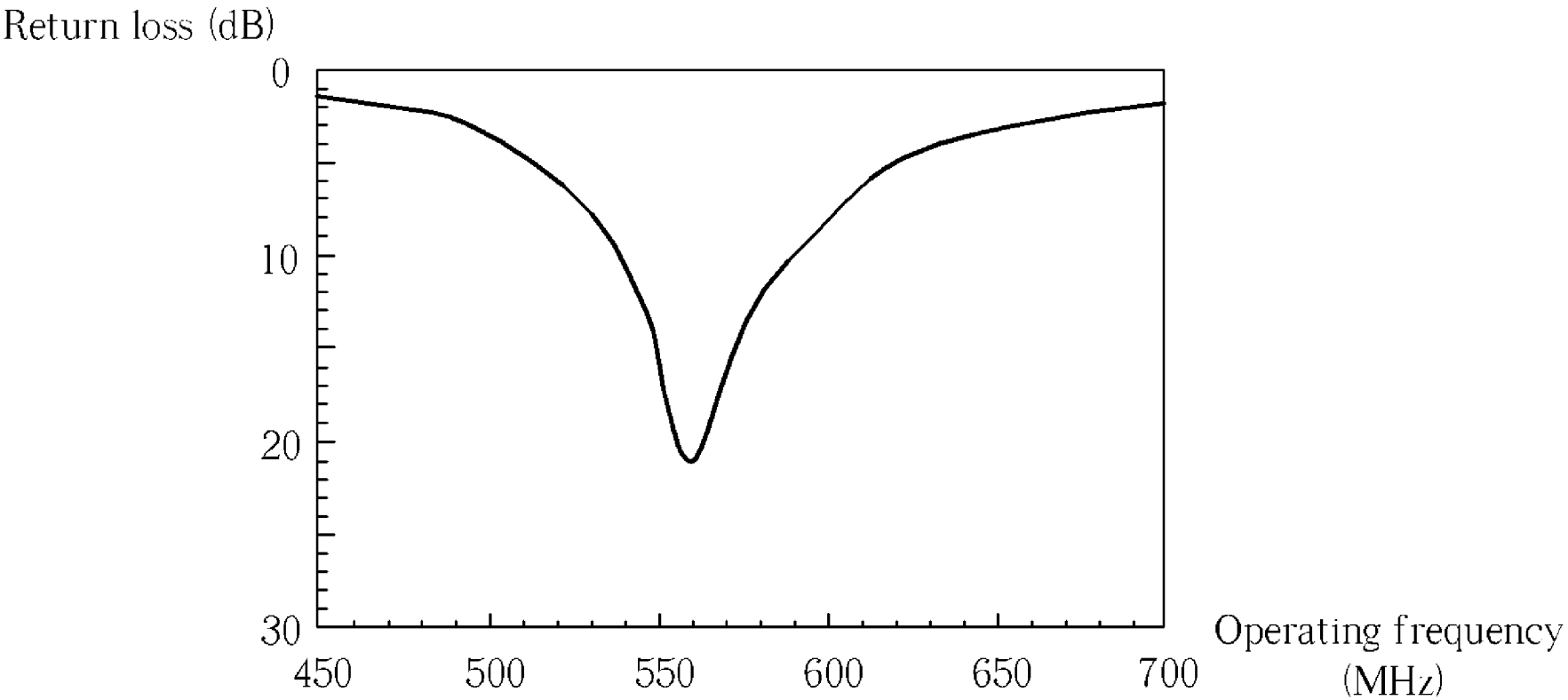
FIG. 3 is a plot illustrating experimental results of return loss corresponding to the antenna in FIG. 1.

FIG. 3 is a plot illustrating experimental results of return loss corresponding to the antenna 101. In this embodiment, the experimental results are based on the following dimensions. The radiating metal sheet 102 is substantially a rectangular radiating metal plate having a length of 90 mm and a width of 20 mm. The width of the meandering radiating metal arm 103 is 4 mm, except that the width near the end point 202 is 7 mm. The distance between any two neighboring portions of the meandering radiating metal arm 103 is 4 mm. The overall height of the meandering radiating metal arm 103 is 95 mm, and the overall width is 20 mm. The flare angle 301 between the meandering radiating metal arm 103 and the radiating metal sheet 102 is 90 degrees. The preset distance 302 between the antenna feeding point 203 of the meandering radiating metal arm 103 and the short side 204 of the radiating metal sheet 102 is 2 mm. The meandering radiating metal arm 103 is formed on a surface of the substrate plate 105 having a thickness of 0.8 mm with printing technology or etching technology. Please refer to FIG. 3. The vertical axis shows values of return loss, and the horizontal axis shows operating frequency. Referring to the experimental results, the return loss of the antenna 101 is above 6 dB in the range of Taiwan digital television channels (i.e. 530-602 MHz). Generally, such return loss is sufficient for receiving digital television signals. Additionally, as the flare angle 301 decreases to be less than 45 degrees, the return loss of the antenna 101 will become worse rapidly. Accordingly, the impedance bandwidth of the antenna 101 is reduced and thus insufficient for covering the whole Taiwan digital television channels (i.e. 530-602 MHz). Additionally, as the preset distance 302 of the antenna 101 increases to be greater than 5 mm, the return loss of the antenna 101 will also become worse.

Figure 4:
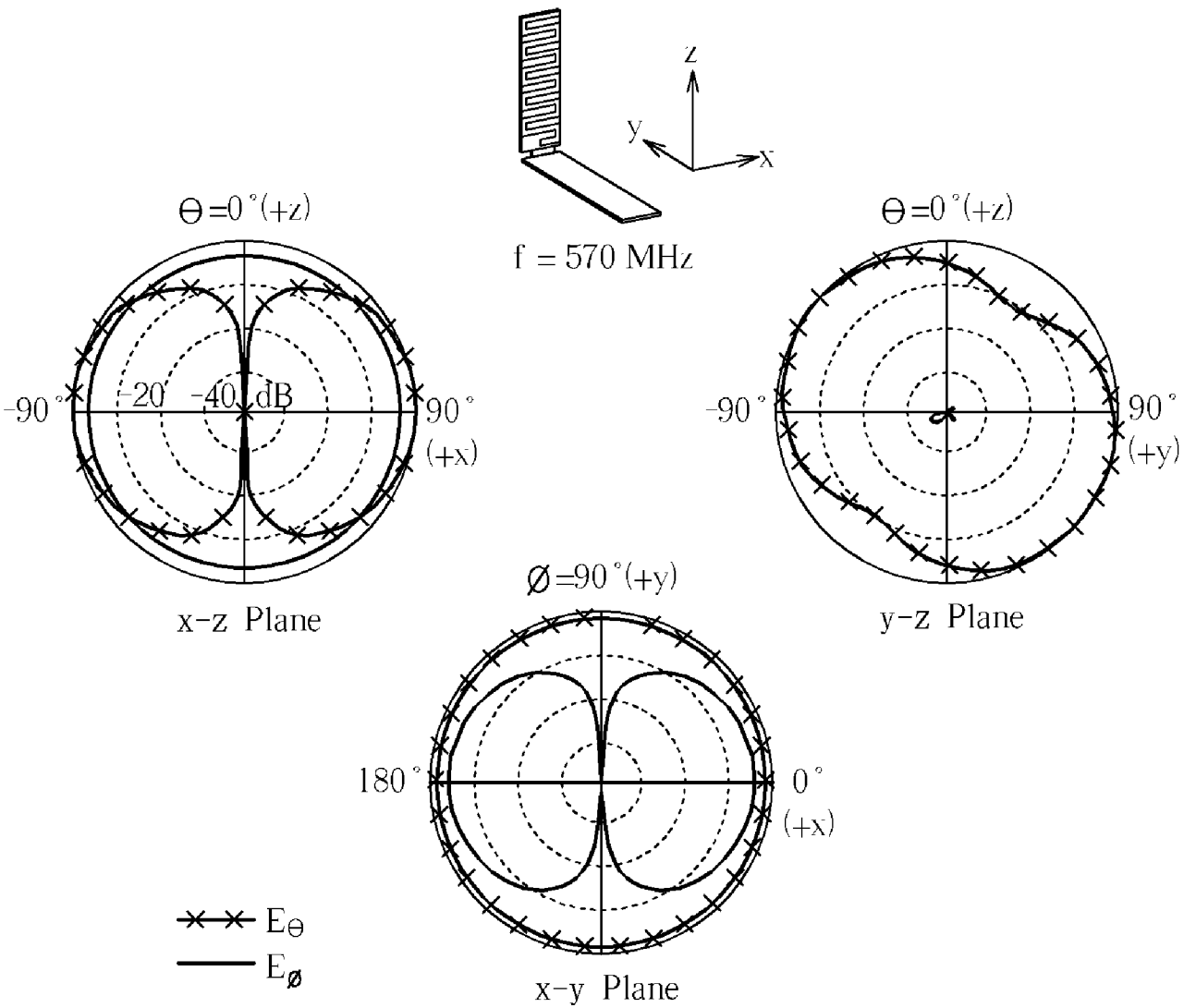
FIG. 4 is a schematic diagram illustrating radiation patterns corresponding to the antenna in FIG. 1 at 570 MHz.

FIG. 4 is a schematic diagram illustrating radiation patterns corresponding to the antenna 101 at 570 MHz. As shown in FIG. 4, the radiation pattern of the horizontal plane (i.e. x-y plane) is substantially omnidirectional, thus satisfying the requirements of digital television channels generally.

Figure 5:
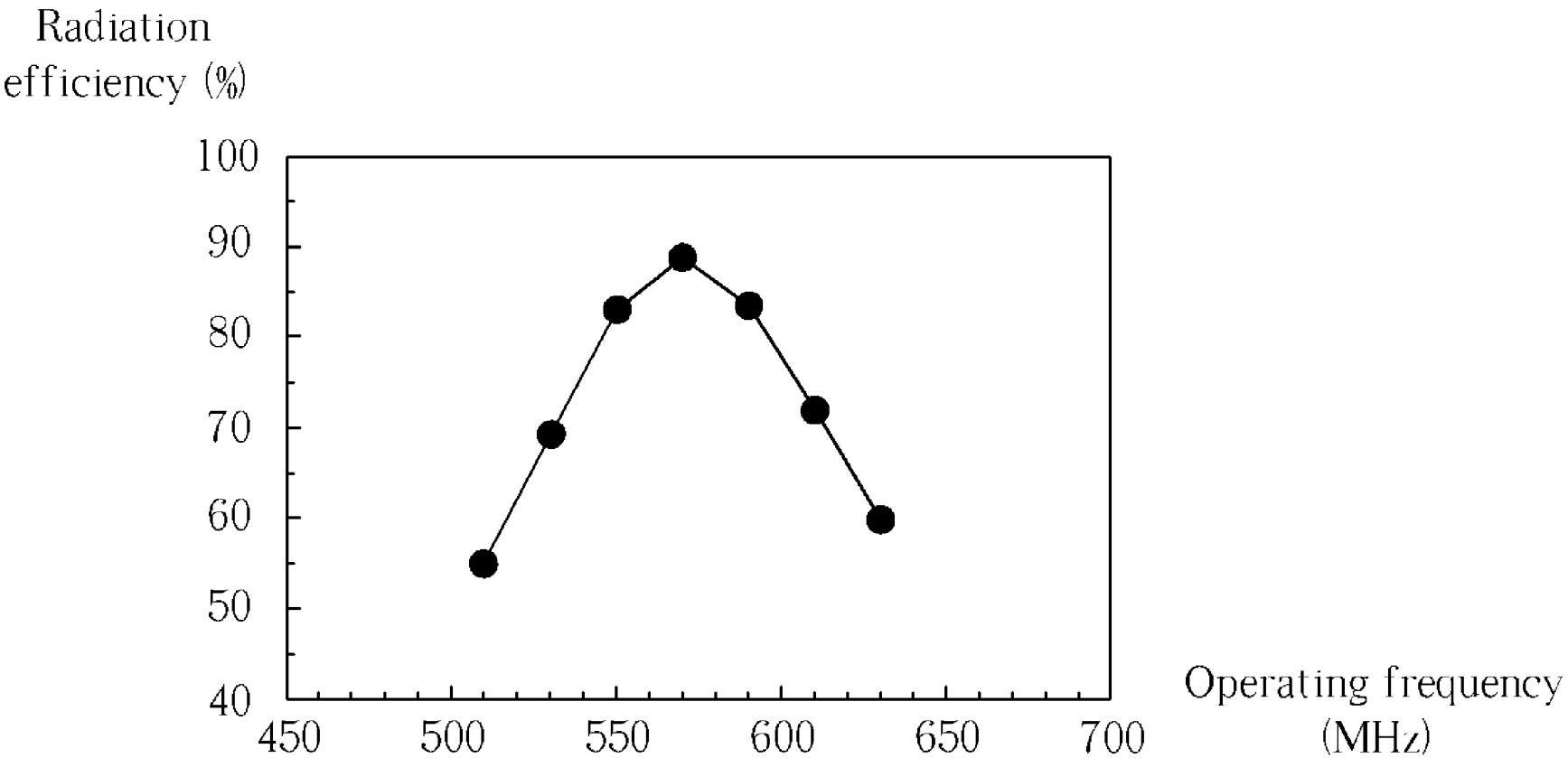
FIG. 5 is a plot illustrating radiation efficiency corresponding to the antenna in FIG. 1.

FIG. 5 is a plot illustrating radiation efficiency corresponding to the antenna 101. Please refer to FIG. 5. The vertical axis shows radiation efficiency, and the horizontal axis shows operating frequency. Referring to the experimental results, the radiation efficiency of the antenna 101 is above 60% in the range of Taiwan digital television channels (i.e. 530-602 MHz). Generally, such radiation efficiency is sufficient for the digital television signal reception.

As described above, the antenna 101 of the present invention can cover the whole Taiwan digital television channels (i.e. 530-602 MHz). Moreover, the antenna 101 operates on condition that the flare angle (or the included angle) 301 between the radiating metal sheet 102 and the meandering radiating metal arm 103 is greater than 45 degrees (i.e. between 45 and 180 degrees). Furthermore, the antenna 101 operates on condition that the shortest distance between the feeding point 203 and the radiating metal sheet 102 is less than 5 mm.

Figure 6:
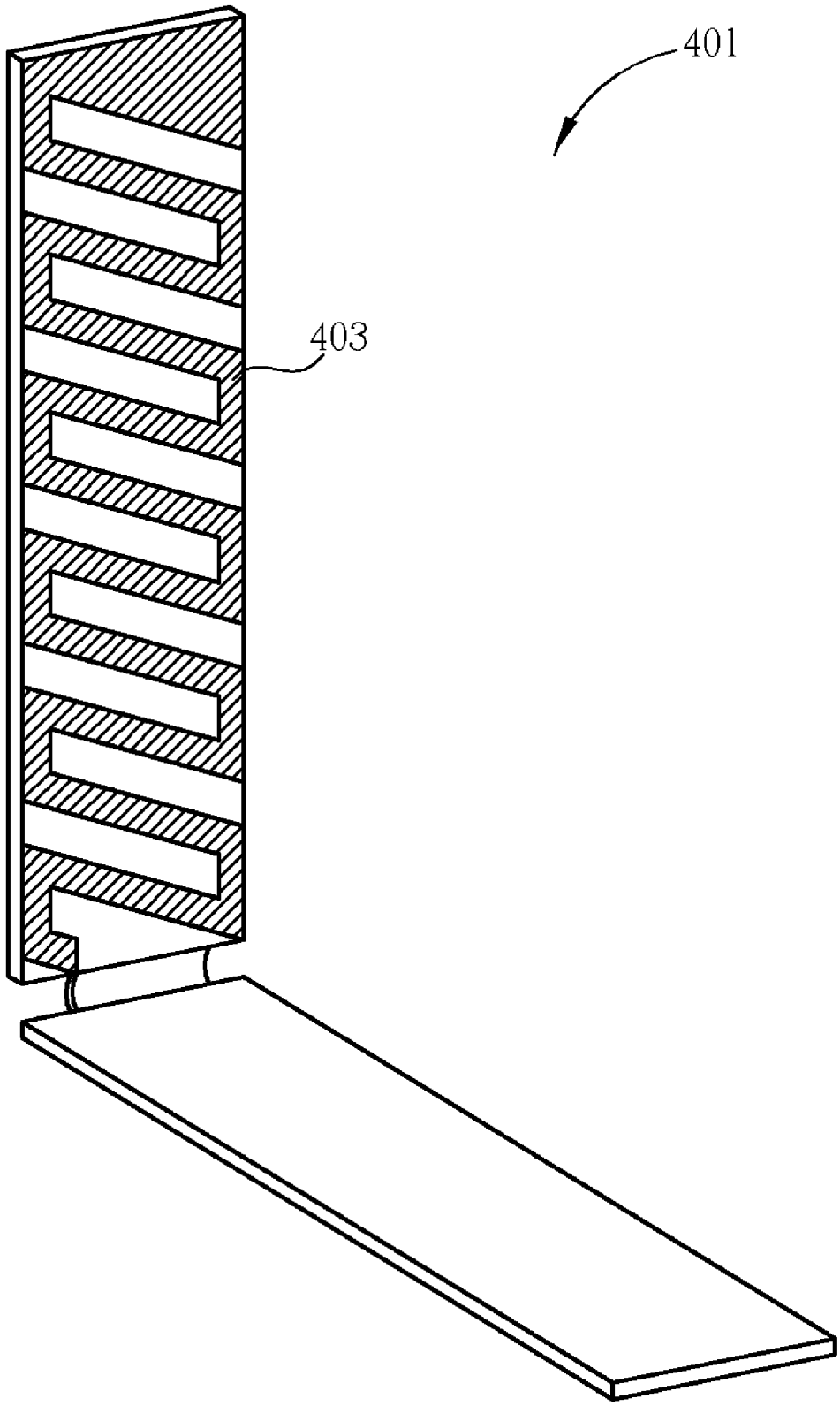
FIG. 6 is a structural diagram illustrating an antenna according to another embodiment of the present invention.
Figure 7:
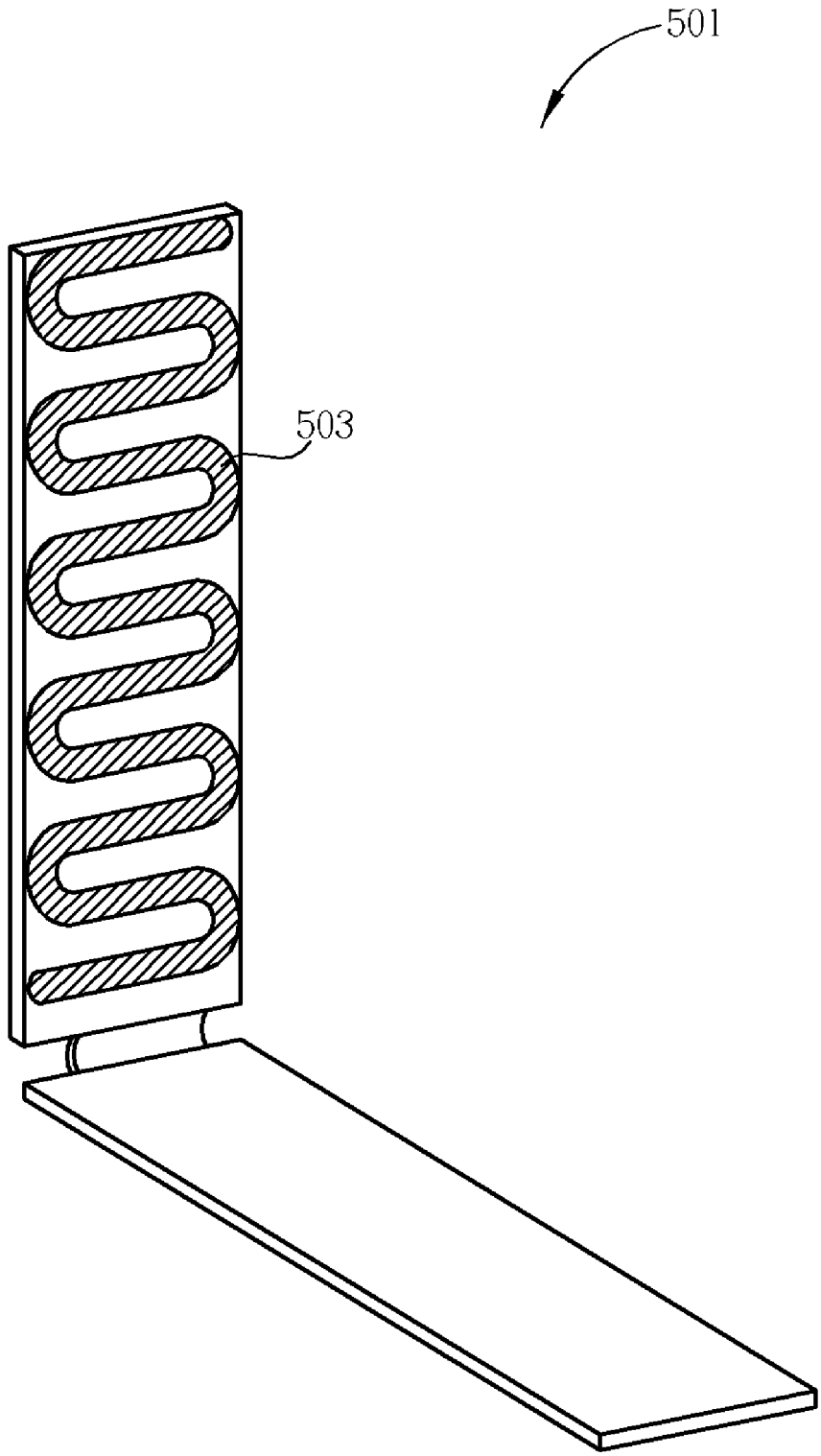
FIG. 7 is a structural diagram illustrating an antenna according to still another embodiment of the present invention.

FIG. 6 is a structural diagram illustrating an antenna 401 according to another embodiment of the present invention, and FIG. 7 is a structural diagram illustrating an antenna 501 according to still another embodiment of the present invention. Although meandering radiating metal arms (i.e. second conducting portions) 403, 503 of the antennas 401, 501 respectively have different shapes from that of the meandering radiating metal arm 103 of the antenna 101, the antennas 401, 501 still follow the principles of the present invention and thus resonance paths of the meandering radiating metal arms 403, 503 are both effectively lengthened. Accordingly, the whole dimensions of the antennas 401, 501 can also be minimized. Briefly speaking, the structures of the antennas 401, 501 are substantially the same as that of the antenna 101 except for the meandering radiating metal arms 403, 503. Additionally, the antennas 401, 501 can also satisfy the requirement of impedance bandwidth and radiation efficiency for the Taiwan digital television channels (i.e. 530-602 MHz).

Figure 8:
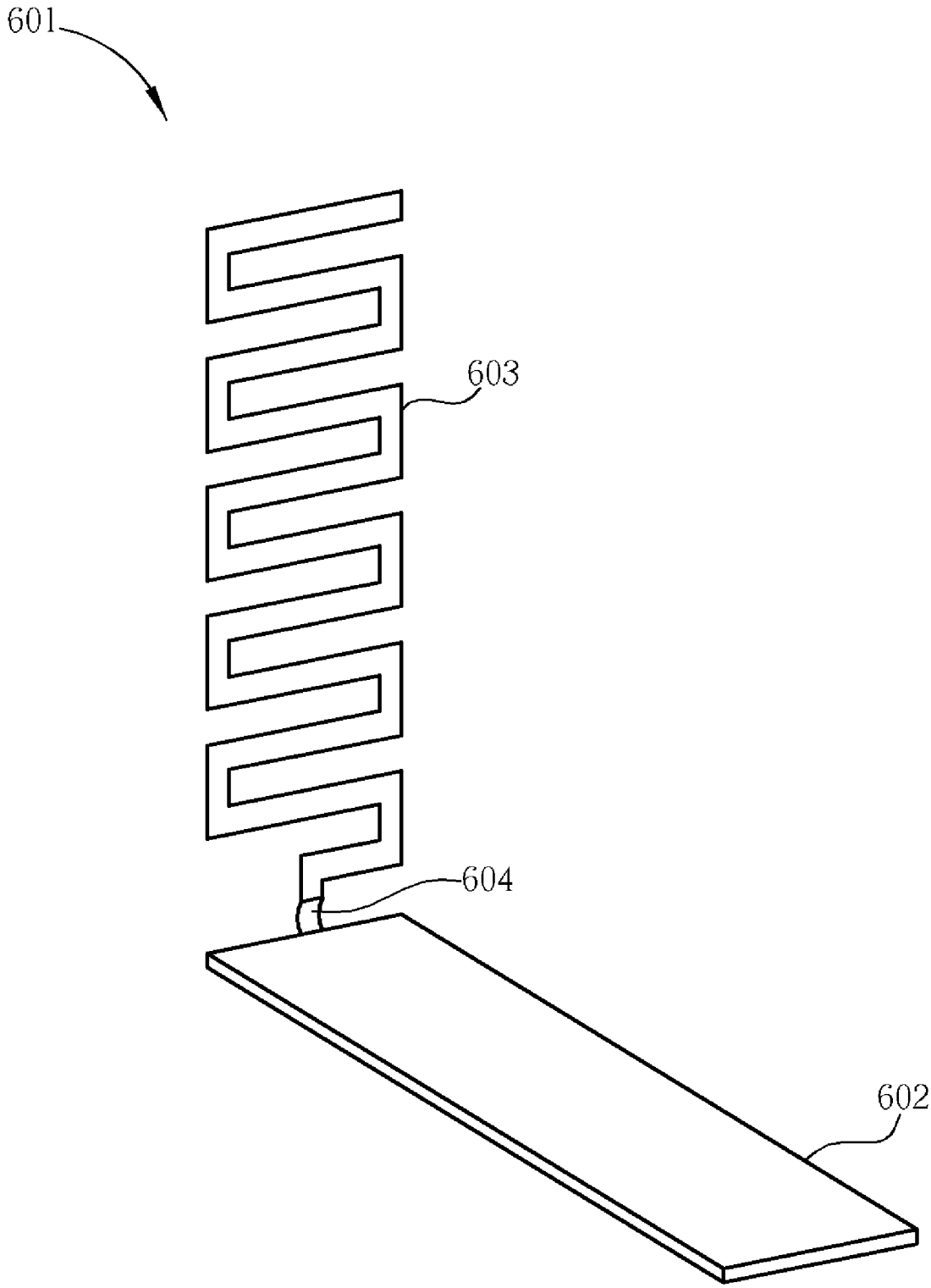
FIG. 8 is a structural diagram illustrating an antenna according to still another embodiment of the present invention.

FIG. 8 is a structural diagram illustrating an antenna 601 according to still another embodiment of the present invention. The structure of the antenna 601 is substantially the same as that of the antenna 101 except that a meandering radiating metal arm (i.e. second conducting portion) 603 of the antenna 601 is cut from a single metal plate, and thus the antenna 601 does not need a substrate plate. Accordingly, a resonance path of the meandering radiating metal arm 603 can also be effectively lengthened, and the whole dimension of the antenna 601 can also be minimized. Moreover, the antenna 601 can also satisfy the requirement of impedance bandwidth and radiation efficiency for the Taiwan digital television channels (i.e. 530-602 MHz). Additionally, the meandering radiating metal arm 603 is an integral radiating metal component substantially on a plane. A flexible insulating portion 604 is connected between a radiating metal sheet 602 and the meandering radiating metal arm 603, so the meandering radiating metal arm 603 is position-adjustable relatively to the radiating metal sheet 602.

Figure 9:
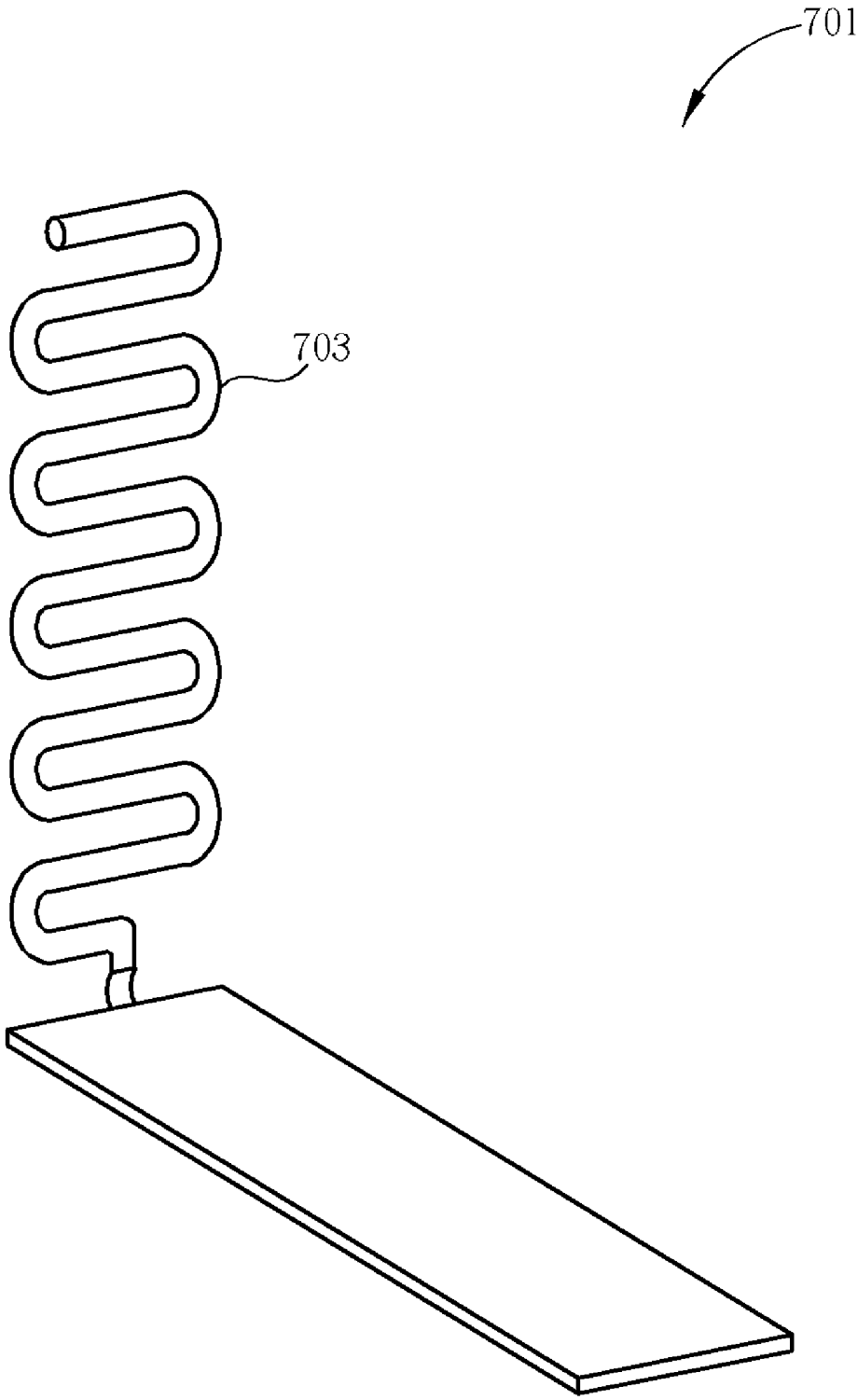
FIG. 9 is a structural diagram illustrating an antenna according to still another embodiment of the present invention.

FIG. 9 is a structural diagram illustrating an antenna 701 according to still another embodiment of the present invention. The structure of the antenna 701 is substantially the same as that of the antenna 601 in the previous embodiment except that a meandering radiating metal arm (i.e. second conducting portion) 703 is a radiating metal wire. Similar to the antenna 601, the antenna 701 does not need a substrate plate. Accordingly, a resonance path of the meandering radiating metal arm 703 can also be effectively lengthened, and the whole dimension of the antenna 701 can also be minimized. Moreover, the antenna 701 can also satisfy the requirement of impedance bandwidth and radiation efficiency for the Taiwan digital television channels (i.e. 530-602 MHz).

In conclusion, by properly designing the shape of the meandering radiating metal arm of the antenna of the present invention, the resonance path of the meandering radiating metal arm can be effectively lengthened, the whole dimension of the antenna can be minimized, and the total height of the antenna in use can be greatly decreased. Moreover, the antenna of the present invention can satisfy the requirement of impedance bandwidth and radiation efficiency for the Taiwan digital television channels (i.e. 530-602 MHz). Thus, the antenna of the present invention is appropriate for the plug-and-play device as a digital television receiving antenna. Additionally, the antenna of the present invention has advantages of simple structure, light and thin body, easy manufacture, low cost, and definite functionality. Therefore, the antenna of the present invention has high application values in industry.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A digital television receiving antenna for a plug-and-play device, comprising:

a first conducting portion;

a second conducting portion, coupled to the first conducting portion and having a resonance path, wherein the second conducting portion is position-adjustable relatively to the first conducting portion, and an effective length of the resonance path is greater than a straight-line distance between two end points of the resonance path; and a flexible insulating portion, connected between the first conducting portion and the second conducting portion, thereby the second conducting portion being position-adjustable relatively to the first conducting portion.

2. The digital television receiving antenna of claim 1, wherein the first conducting portion and the second conducting portion are a pair of resonating radiators.

3. The digital television receiving antenna of claim 1, wherein the second conducting portion is meandering.

4. The digital television receiving antenna of claim 1, further comprising:

a base plate, coupled to the first conducting portion and being position-adjustable relatively to the first conducting portion;

wherein the second conducting portion is formed on a surface of the base plate with printing technology or etching technology.

5. The digital television receiving antenna of claim 1, wherein the first conducting portion is a rectangular radiating metal plate.

6. The digital television receiving antenna of claim 1, wherein the second conducting portion is substantially on a plane.

7. The digital television receiving antenna of claim 1, wherein the second conducting portion is an integral radiating metal component.

8. The digital television receiving antenna of claim 7, wherein the second conducting portion is a radiating metal wire.

9. The digital television receiving antenna of claim 1, wherein when the second conducting portion is adjusted to a closed position, the first conducting portion and the second conducting portion are substantially parallel.

10. The digital television receiving antenna of claim 1, wherein the digital television receiving antenna operates on condition that a flare angle between the first conducting portion and the second conducting portion is greater than 45 degrees.

11. The digital television receiving antenna of claim 1, wherein one of the two end points of the resonance path is a feeding point of the digital television receiving antenna, and the digital television receiving antenna operates on condition that a shortest distance between the feeding point and the first conducting portion is less than a specific value such that a return loss of the digital television receiving antenna is less than a predetermined value.

12. The digital television receiving antenna of claim 1, wherein the digital television receiving antenna is configured in a plug-and-play device, and the first conducting portion is a system ground plane of the plug-and-play device.

13. A digital television receiving antenna for a plug-and-play device, comprising:

a first conducting portion;

a second conducting portion, coupled to the first conducting portion and having a resonance path, wherein the second conducting portion is position-adjustable relatively to the first conducting portion, and an effective length of the resonance path is greater than a straight-line distance between two end points of the resonance path;

a flexible insulating portion, connected between the first conducting portion and the second conducting portion, thereby the second conducting portion being position-adjustable relatively to the first conducting portion;

wherein the second conducting portion is substantially on a plane.

* * * * *